US007286792B2

(12) United States Patent
Terao et al.

(10) Patent No.: US 7,286,792 B2
(45) **Date of Patent: *Oct. 23, 2007**

(54) SHEET POST-PROCESS APPARATUS AND WAITING TRAY

(75) Inventors: Yasunobu Terao, Tagata-gun (JP); Tokihiko Ise, Tagata-gun (JP); Hajime Yamamoto, Mishima (JP); Reiji Murakami, Yokohama (JP); Hiroyuki Taki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 128 days.

This patent is subject to a terminal disclaimer.

(21) Appl. No.: 11/008,381

(22) Filed: Dec. 10, 2004

(65) Prior Publication Data

US 2006/0067771 A1 Mar. 30, 2006

(30) Foreign Application Priority Data

Sep. 28, 2004 (JP) ..... 2004-282211

(51) Int. Cl.
*G03G 15/00* (2006.01)

(52) U.S. Cl. ..... 399/407; 270/58.08

(58) Field of Classification Search ..... 399/407, 399/408, 410; 270/37, 52.18, 58.08, 58.11, 270/58.12, 58.14, 58.16, 58.18; 271/189, 271/190, 191, 192

See application file for complete search history.

(56) References Cited

U.S. PATENT DOCUMENTS

| | | | |
|---|---|---|---|
| 4,473,425 | A | 9/1984 | Baughman et al. |
| 4,611,741 | A | 9/1986 | Wilson |
| 4,794,859 | A | 1/1989 | Huseby et al. |
| 4,849,796 | A | 7/1989 | Murakami |
| 4,898,374 | A | 2/1990 | Vermaat |
| 4,917,366 | A | 4/1990 | Murakami et al. |
| 5,020,784 | A | 6/1991 | Asami et al. |
| 5,021,837 | A | 6/1991 | Uto et al. |
| 5,098,074 | A | 3/1992 | Mandel et al. |
| 5,282,611 | A | 2/1994 | Ueda et al. |
| 5,285,249 | A | 2/1994 | Mahoney |
| 5,289,251 | A | 2/1994 | Mandel et al. |
| 5,337,134 | A | 8/1994 | Sato et al. |
| 5,370,384 | A | 12/1994 | Romanowski |

(Continued)

FOREIGN PATENT DOCUMENTS

| | | |
|---|---|---|
| JP | 61-078162 U | 5/1986 |

(Continued)

OTHER PUBLICATIONS

U.S. Appl. No. 11/085,226, filed Mar. 22, 2005, Terao et al.

(Continued)

*Primary Examiner*—Ren Yan
(74) *Attorney, Agent, or Firm*—Foley & Lardner LLP

(57) ABSTRACT

A waiting tray has left and right lower face support members releasably provided in left and right directions, the support members supporting left and right lower faces in a transport direction of a sheet transported to a waiting tray, and an upper face slash member which slashes an upper face of the sheet transported to the waiting tray to drop the sheet onto a processing tray.

20 Claims, 14 Drawing Sheets

U.S. PATENT DOCUMENTS

| | | | |
|---|---|---|---|
| 5,418,606 | A | 5/1995 | Kikuchi et al. |
| 5,435,544 | A | 7/1995 | Mandel |
| 5,449,157 | A | 9/1995 | Kawano et al. |
| 5,451,037 | A | 9/1995 | Lundstrom |
| 5,590,871 | A | 1/1997 | Okabe et al. |
| 5,622,359 | A | 4/1997 | Kawano et al. |
| 5,628,502 | A | 5/1997 | Amarakoon |
| 5,640,232 | A | 6/1997 | Miyake et al. |
| 5,676,517 | A | 10/1997 | Lotz |
| 5,709,376 | A | 1/1998 | Ushirogata |
| 5,934,140 | A | 8/1999 | Jackson et al. |
| 5,961,274 | A | 10/1999 | Bors |
| 5,971,384 | A | 10/1999 | Asao |
| 6,022,011 | A | 2/2000 | Hirose |
| 6,065,747 | A | 5/2000 | Khovaylo et al. |
| 6,092,948 | A | 7/2000 | Altfather |
| 6,102,385 | A | 8/2000 | Wakamatsu et al. |
| 6,120,020 | A | 9/2000 | Asao |
| 6,142,461 | A | 11/2000 | Asao et al. |
| 6,145,828 | A | 11/2000 | Arai |
| 6,146,085 | A | 11/2000 | Namba et al. |
| 6,179,287 | B1 | 1/2001 | Watanabe et al. |
| 6,231,039 | B1 | 5/2001 | Chung |
| 6,330,999 | B2 | 12/2001 | Coombs et al. |
| 6,336,630 | B1 | 1/2002 | Holtman et al. |
| 6,354,059 | B1 | 3/2002 | Yoshie et al. |
| 6,357,753 | B1 | 3/2002 | Yamasaki et al. |
| 6,371,472 | B1 | 4/2002 | Miyake et al. |
| 6,450,934 | B1 | 9/2002 | Coombs |
| 6,581,922 | B2 | 6/2003 | Kuwata et al. |
| 6,600,885 | B2 | 7/2003 | Kida |
| 6,641,129 | B2 | 11/2003 | Ogita et al. |
| 6,659,455 | B2 | 12/2003 | Endo et al. |
| 6,671,492 | B2 | 12/2003 | Mimura et al. |
| 6,674,983 | B2 | 1/2004 | Enomoto et al. |
| 6,698,744 | B2 | 3/2004 | Yamada et al. |
| 6,712,349 | B2 | 3/2004 | Watanabe |
| 6,722,646 | B2 | 4/2004 | Sekiyama et al. |
| 6,722,650 | B1 | 4/2004 | Abbata et al. |
| 6,733,006 | B2 | 5/2004 | Kobayashi et al. |
| 6,733,007 | B2 | 5/2004 | Sekiyama et al. |
| 6,767,012 | B2 | 7/2004 | Sasamoto |
| 6,819,906 | B1 | 11/2004 | Herrmann et al. |
| 6,824,128 | B2 | 11/2004 | Nagata et al. |
| 6,848,685 | B2 | 2/2005 | Katsuyama |
| 6,871,042 | B2 | 3/2005 | Nemura et al. |
| 6,910,686 | B2 | 6/2005 | Awano |
| 6,928,259 | B2 | 8/2005 | Sakuma |
| 6,988,728 | B2 | 1/2006 | Kida |
| 7,104,538 | B1 | 9/2006 | Kimura et al. |
| 2002/0047233 | A1 | 4/2002 | Coombs et al. |
| 2002/0053766 | A1 | 5/2002 | Kubota |
| 2002/0074708 | A1 | 6/2002 | Nagata et al. |
| 2002/0163119 | A1 | 11/2002 | Kawata |
| 2003/0057625 | A1 | 3/2003 | Kuwata et al. |
| 2003/0155705 | A1 | 8/2003 | Sekiyama et al. |
| 2003/0214090 | A1 | 11/2003 | Kato et al. |
| 2004/0032073 | A1 | 2/2004 | Sasamoto |
| 2004/0113348 | A1 | 6/2004 | Awano |
| 2004/0126163 | A1 | 7/2004 | Asami et al. |
| 2004/0181308 | A1 | 9/2004 | Hayashi et al. |
| 2005/0000336 | A1 | 1/2005 | Hattori et al. |

FOREIGN PATENT DOCUMENTS

| | | | |
|---|---|---|---|
| JP | 62-008965 | A | 1/1987 |
| JP | 63-035756 | U | 3/1988 |
| JP | 02-055369 | A | 2/1990 |
| JP | 03-088667 | A | 4/1991 |
| JP | 04-079857 | U | 7/1992 |
| JP | 04-312894 | A | 11/1992 |
| JP | 04-354756 | A | 12/1992 |
| JP | 05-238103 | A | 9/1993 |
| JP | 08-259073 | A | 10/1996 |
| JP | 2583594 | B2 | 11/1996 |
| JP | 10-095563 | A | 4/1998 |
| JP | 10-279169 | A | 10/1998 |
| JP | 10-324449 | A | 12/1998 |
| JP | 11-011786 | A | 1/1999 |
| JP | 11-043257 | A | 2/1999 |
| JP | 11-147641 | A | 6/1999 |
| JP | 11-208967 | A | 8/1999 |
| JP | 11-231753 | A | 8/1999 |
| JP | 11-301912 | A | 11/1999 |
| JP | 2000-095420 | A | 4/2000 |
| JP | 2000-159414 | A | 6/2000 |
| JP | 2001-048411 | A | 2/2001 |
| JP | 2001-089009 | A | 4/2001 |
| JP | 2001-316029 | A | 11/2001 |
| JP | 2002-060118 | A | 2/2002 |
| JP | 2002-308509 | A | 10/2002 |
| JP | 2003-081517 | A | 3/2003 |
| JP | 2003-171057 | A | 6/2003 |
| JP | 2003-246536 | A | 9/2003 |
| JP | 2003-335450 | A | 11/2003 |
| JP | 2004-83261 | A | 3/2004 |
| JP | 2004-142868 | A | 5/2004 |

OTHER PUBLICATIONS

U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
U.S. Appl. No. 11/008,122, filed Dec. 10, 2004, Sasahara.
U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,392, filed Dec. 10, 2004, Terao et al.

SHEET POST-PROCESS APPARATUS AND WAITING TRAY

CROSS-REFERENCE TO RELATED APPLICATIONS

This application is based upon and claims the benefit of priority from prior Japanese Patent Application No. 2004-282211, filed Sep. 28, 2004, the entire contents of which are incorporated herein by reference.

BACKGROUND OF THE INVENTION

1. Field of the Invention

The present invention relates to an apparatus (finisher) for bundling sheets sent from an image forming apparatus, thereby carrying out, for example, staple processing, and a waiting tray for use in the post-process apparatus.

2. Description of the Related Art

A post-process apparatus comprises: a processing tray for bundling sheets sent from an image forming apparatus, thereby carrying out, for example, staple processing, and then ejecting the processed bundles of sheets; and a storage tray for holding the ejected bundles of sheets. A staple processing speed of the post-process apparatus is slow as compared with an image processing speed of the image forming apparatus. Thus, if a sheet is directly sent to the processing tray, a sheet to be staple processed next is transported while a preceding sheet is staple processed. In order to prevent this problem, conventionally, a buffer mechanism for adjusting a carrying-in timing of a sheet at a front stage of the processing tray is proposed.

Japanese Patent Document 1: Japanese Patent No. 2583594 discloses a mechanism for retaining sheets is provided at a transport passage for sending sheets sent from an image forming apparatus to a processing tray. However, in this case, there is a need for increasing the transport passage in length, and, as a result, the post-process apparatus is likely to be large in size.

Japanese Patent Document 2: Jpn. Pat. Appln. KOKAI Publication No. 2004-83261 discloses a roller for slashing held sheets. However, this roller is not intended for forcibly dropping the sheets on the processing sheet, and is technically different from that of the present invention. Therefore, advantageous effect of the present invention is attained.

BRIEF SUMMARY OF THE INVENTION

The Inventors proposes here that a waiting tray is newly allocated as a buffer mechanism at an upper stage of a processing tray. The waiting tray according to this proposal is allocated to be proximal to an upper stage of the processing tray, and a sheet transported from an image forming apparatus to the processing tray is temporarily retained here in a waiting mode. At a time point when retention in a waiting mode is released, that is, at a time point when staple processing of a bundle of sheets at the processing tray terminates, and then, the bundle of sheets is transported from the processing tray to a storage tray, the sheet is supported on a bottom face of the waiting tray. By opening this tray, the sheet is then dropped at the distal end side (upstream side when the sheet is transported to the waiting tray) to the processing tray. By using this waiting tray, equipment can be allocated with a simple mechanism without a need to increase a transport passage in length and providing a space. As a result, a post-process apparatus can be made compact.

Moreover, it is possible to send the sheets to the processing tray without any malfunction.

The present invention provides a sheet post-process apparatus for reliably dropping a sheet retained on a waiting tray in a waiting mode on a processing tray.

In order to solve the above-described problem, the present invention comprises the following features.

1. A sheet post-process apparatus, the apparatus comprising:

a waiting tray which temporarily retains a transported sheet in a waiting mode, and releases the retention to drop the sheet;

a processing tray which bundles sheets dropped from the waiting tray to carry out predetermined processing, and ejects the sheets; and a storage tray which holds the bundle of sheets processed and ejected on the processing tray, wherein the waiting tray comprises:

left and right lower face support members which support left and right lower faces in a sheet transport direction during retention in a waiting mode and release the support of the left and right lower faces during release of the retention; and an upper face slash member allocated upwardly of the left and right lower face support members, the slash member slashing an upper face of the sheet transported to the waiting tray to drop the sheet onto the processing tray.

2. A sheet post-process apparatus according to 1, wherein the upper face slash member comprises a spatula shaped body whose proximal end side is lowered in a sheet direction while a proximal shaft side is defined as a turning center.

3. A sheet post-process apparatus according to 1, wherein the upper face slash member projects one or a plurality of piece shaped bodies for slashing an upper face of sheet with intervals in a peripheral direction of a rotary shaft.

4. A sheet post-process apparatus according to 1, wherein the upper face slash member is allocated so as to slash a center portion at a proximal end in a sheet transport direction.

5. A sheet post-process apparatus according to 1, wherein the waiting tray is allocated to be proximal to an upper stage of the processing tray, the processing tray and the waiting tray are allocated in an inclined shape which is high at a proximal end side of a sheet to be transported and which is low at a distal end side, the processing tray and the waiting tray are shorter in length of a sheet transport direction thereof than a length of a standard sheet to be held, and a part of the proximal end side in the transport direction of the sheet to be held on the waiting tray is held on the storage tray.

6. A sheet post-process apparatus, the apparatus comprising:

waiting means for temporarily retaining a transported sheet in a waiting mode and releasing the retention to drop the sheet;

processing means for bundling sheets dropped from the waiting means to carry out predetermined processing and ejecting the sheets; and storage means for holding the bundle of sheets processed and ejected by the processing means, wherein the waiting means comprises:

left and right lower face support means for supporting left and right lower faces in a sheet transport direction during retention in a waiting mode and releasing the support of the left and right lower faces during release of the retention; and upper face slash means allocated upwardly of the left and right lower face support means, for slashing an upper face of the sheet transported to the waiting means to drop the sheet onto the processing means.

In the present specification and claims, the proximal end side, distal end side, and sheet width are defined as follows. That is, when a direction of transporting a sheet to be transported to a waiting tray is defined as a reference, a downstream side in the transport direction is defined as a proximal end side; an upstream side in the transport direction is defined as a distal end side; and a length in a transverse direction when the sheet transport direction is defined as a longitudinal direction is defined as a sheet width. In addition, the sheet used here denotes copy sheet produced when a toner image (developing image) is copied, and the copied sheet is sent from the image forming apparatus.

According to the present invention, when retention in a waiting mode, of the sheet existing on the waiting tray, is released, the upper face slash member is actuated to slash the proximal end side (downstream side) of the sheet from its upper face to the distal end direction. By doing this, the sheet is forcibly dropped on the processing tray reliably, and the coincidence (alignment) of the sheet distal end can be improved.

DETAILED DESCRIPTION OF THE INVENTION

Now, one embodiment of the present invention will be described here.

(General Description of Image Forming Apparatus)

Figure 18:
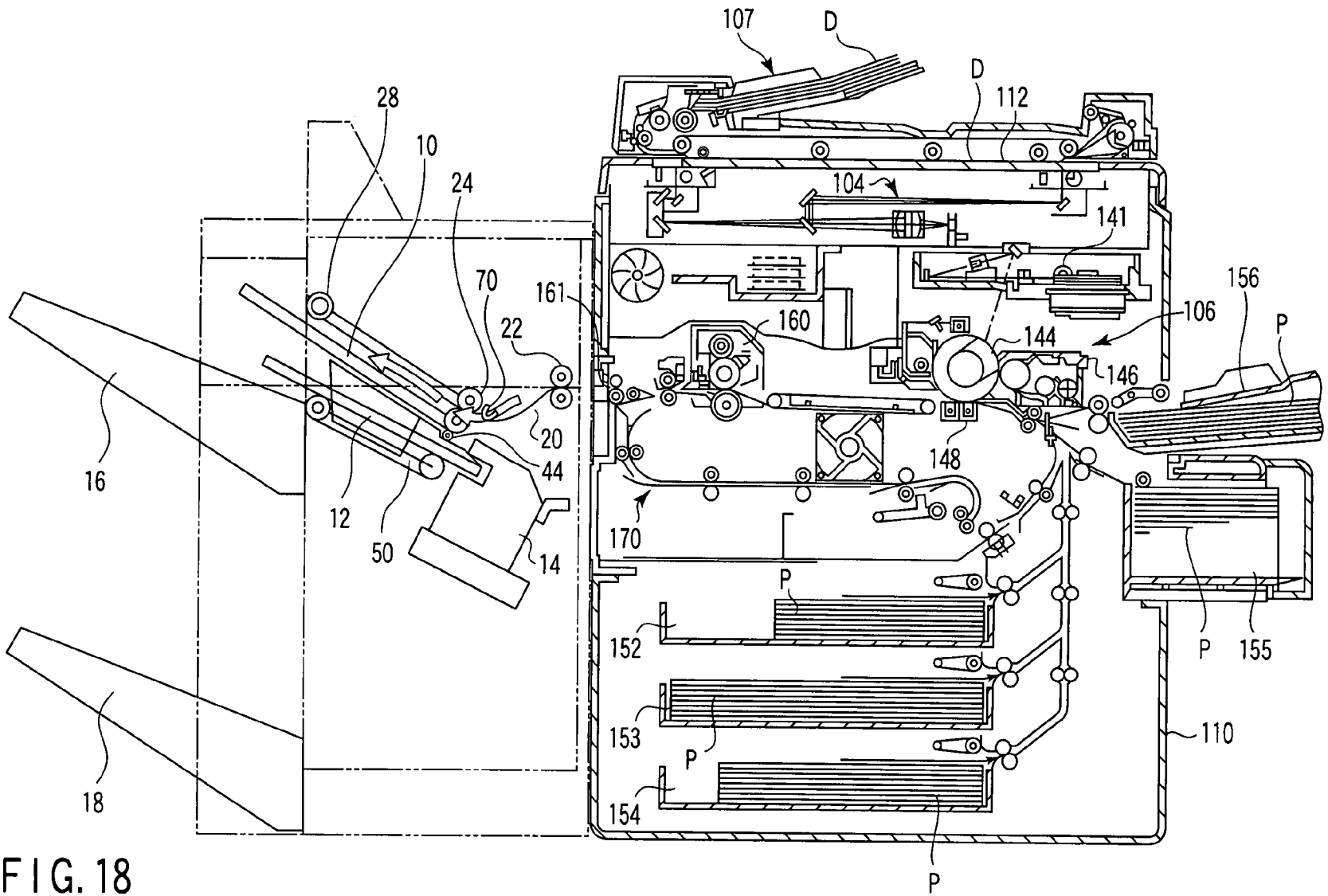
FIG. 18 is a view showing a combination of the post-process apparatus of the invention and an image forming apparatus.

A general description of an image forming apparatus (digital copying machine) allocated at a front stage of a post-process apparatus according to the present invention will be given with reference to FIG. 18. A document placement base 112 is provided at an upper face of this apparatus. An auto document feeder 117 (hereinafter, referred to as an ADF) for automatically feeding a document D onto the document placement base 112 is allocated on the document placement base. The document D is placed on the ADF, predetermined settings (for example, the presence or absence of staple processing, how to carry out staple processing, the number of copies, or size of sheet to be copied), and then, a copy start button is pressed. The document D on the ADF is transported to a predetermined location of the document placement base 112.

A scanner unit 4, a printer unit 6, and a copy sheet cassette and feeder are arranged at the inside of the image forming apparatus. At the scanner unit 4, the document D on the document placement base 112 is scanned, and reflection light thereof is incident. The incident reflection light is converted in a photoelectric manner, image information on the document D is read, and a photoelectric signal corresponding to the read image information is output. At the printer unit 6, according to the image information or the like on the read document D, an electrostatic latent image is formed on a peripheral face of a photosensitive drum 144 by a semiconductor laser 141. Then, a toner is supplied from a developing device 146 to the photosensitive drum 144; the electrostatic latent image formed on the photosensitive drum 144 is substantially produced, and a tone image is formed.

To this photosensitive drum 144, a copy sheet P is sent from cassettes 52, 53, 54, and 56 or a feeder 55 for the copy sheet P, and the toner image on the photosensitive drum 144 is copied onto the copy sheet by a transfer charger 148. Then, the toner image of the copy sheet is fixed by a fixing device 150, and the fixed toner image is ejected from an ejection port 161. This sheet comes under the sheet of the present specification and claims.

In a control circuit of the image forming apparatus side, information concerning a sheet such as sheet size, the presence or absence of sort, or the presence or absence of staple processing is inputted by means of operator's data input and/or an input signal from sensor means provided in the image forming apparatus. The control circuit at the image forming apparatus side sends information concerning a sheet transported to the control circuit of the post-process apparatus side based on these items of information. The information includes the following:

the sheet is provided as a sheet retained in the waiting tray in a waiting mode, the sheet being a sheet other than a last sheet to be held;

the sheet is provided as a sheet retained in the standby sheet in a waiting mode, the sheet being a last sheet to be held;

the sheet is provided as a sheet retained in the waiting tray in a waiting mode (a sheet being directly dropped on the processing sheet);

the sheet is provided as a sheet being directly ejected to the storage tray without being dropped on the waiting tray; or the sheet being larger than a set sheet (for example, sheet of A3 in size or sheet of small size or beyond the specified size).

(General Description of Post-Process Apparatus)

A general description of a post-process apparatus will be given with reference to FIG. 18. The post-process apparatus is provided as an apparatus for bundling sheets 20 transported from an image forming apparatus, thereby carrying out staple processing or the like. This post-process apparatus is allocated in contact with an ejection port 161 of the image forming apparatus. That is, a sheet transport inlet is provided in association with the ejection port 161 of the image forming apparatus, and an inlet roller 22 is allocated in this sheet transport inlet. The inlet roller 22 introduces the sheets 20 into a paper pass ceiling 36 for forming a transport passage in the post-process apparatus (refer to FIG. 1). This paper pass ceiling 36 guides a sheet to a waiting tray 10 and a processing tray 12. Two storage trays 16 and 18 are allocated at the downstream side of the processing tray 12 (at the downstream side of the waiting tray 10).

The waiting tray 10 is allocated to be proximal to the upper stage of the processing tray 12 while the waiting tray is inclined so as to be upward at the proximal end side of the sheet to be transported and so as to be downward at the distal end side. A paper feed roller 24 is provided at the distal end side of this waiting tray 10 (at the upstream side of the sheet to be transported)., and a waiting tray roller 28 is provided at the proximal end side of the tray (at the downstream side of the sheet to be transported). A sheet sensor 70 is provided at the transport inlet of the paper feed roller 24. This sensor senses a proximal end and a distal end of the sheet to be transported.

The processing tray 12 is allocated at the lower stage of the processing tray 12 while the processing tray is inclined so as to be upward at the proximal end side of the sheet (at the downward side of the sheet to be transported to the storage tray) and so as to be downward at the distal end side (upstream side of the sheet to be transported to the ejected paper holding tray). A stapler 14 is provided at the distal end side of the processing tray 12. A transport mechanism 50 is provided on the processing tray 12 so as to transport a bundle of staple processed sheets or the like to the storage tray 16 or 18.

Here, in the post-process apparatus according to the present invention, the waiting tray 10 and the processing try 12 both are small in size, as compared with the size of sheet to be transported in order to make equipment compact. When a sheet is dropped from the waiting tray 10 to the processing tray 12, that sheet is held across the processing tray 12 and the storage tray 16 (or 18) (refer to FIGS. 10 to 13).

According to a control circuit of the post-process apparatus, the waiting tray 10 makes a proper operation based on information concerning a sheet obtained from the control circuit at the image forming apparatus side and information available from a sheet sensor 70.

When a sheet transported to the waiting tray is provided as a sheet which should be retained on the waiting tray in a waiting mode, the sheet being a sheet other than a last sheet to be held, this sheet is kept to be held in a proper location of the waiting tray.

When the above sheet is provided as a sheet to be retained on the standby sheet in a waiting mode, the sheet being a last sheet to be held, that sheet is aligned in a proper location, and is dropped on the processing tray together with the sheet which has been held in advance on the waiting tray.

When the sheet is provided as a sheet which is not required to be retained on the waiting tray in a waiting mode, that sheet is directly dropped on the processing tray.

When the sheet is provided as a sheet to be directly ejected on the storage tray without being dropped on the processing tray, that sheet is directly transported from the waiting tray to the storage tray without intervening the processing tray.

When the sheet is provided as a sheet which is larger than a set sheet (for example, a sheet of A3 in size), the waiting tray is increased in length by expanding it.

<Waiting Tray>

Figure 1:
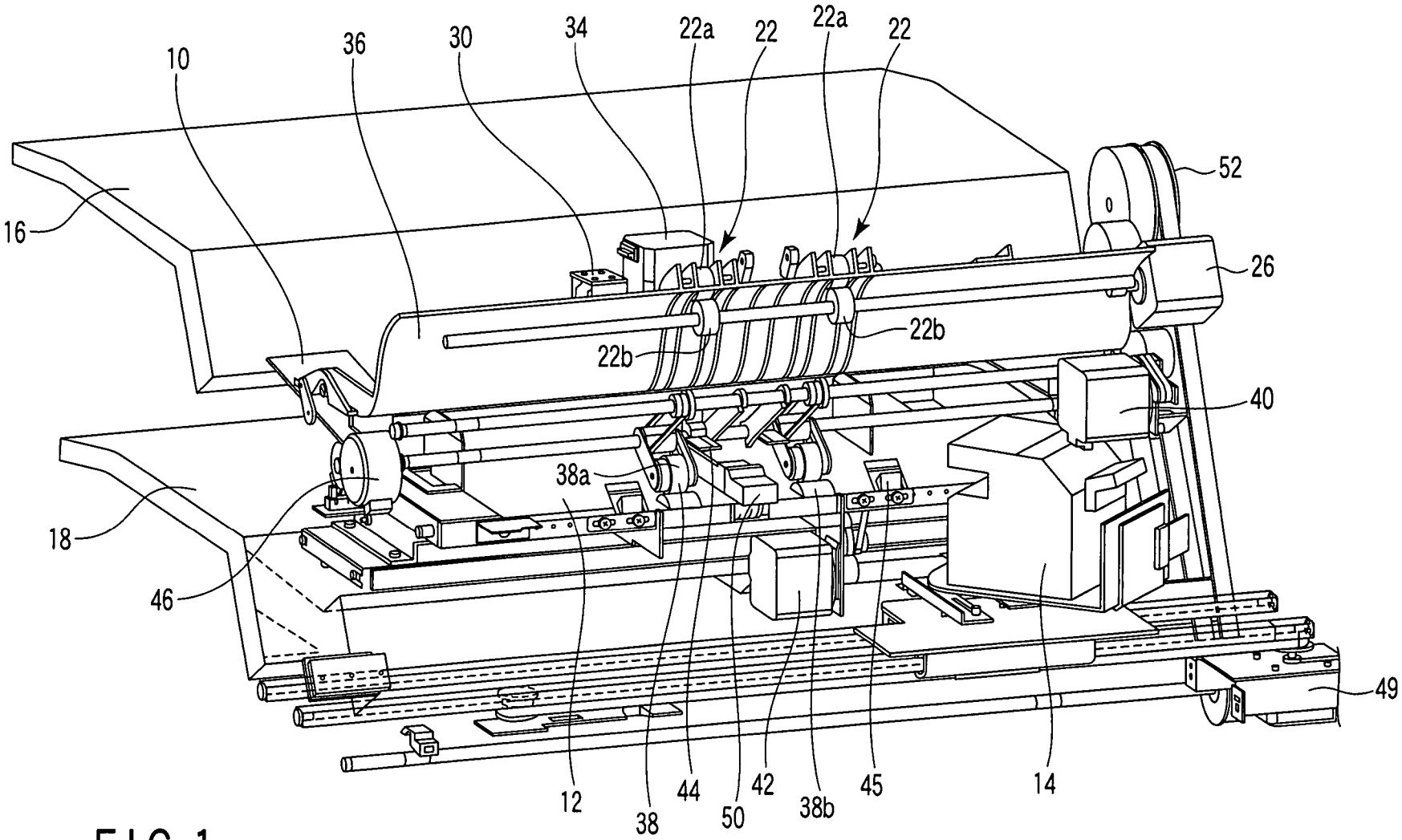
FIG. 1 is a perspective view of a post-process apparatus showing one embodiment of the present invention.
Figure 2:
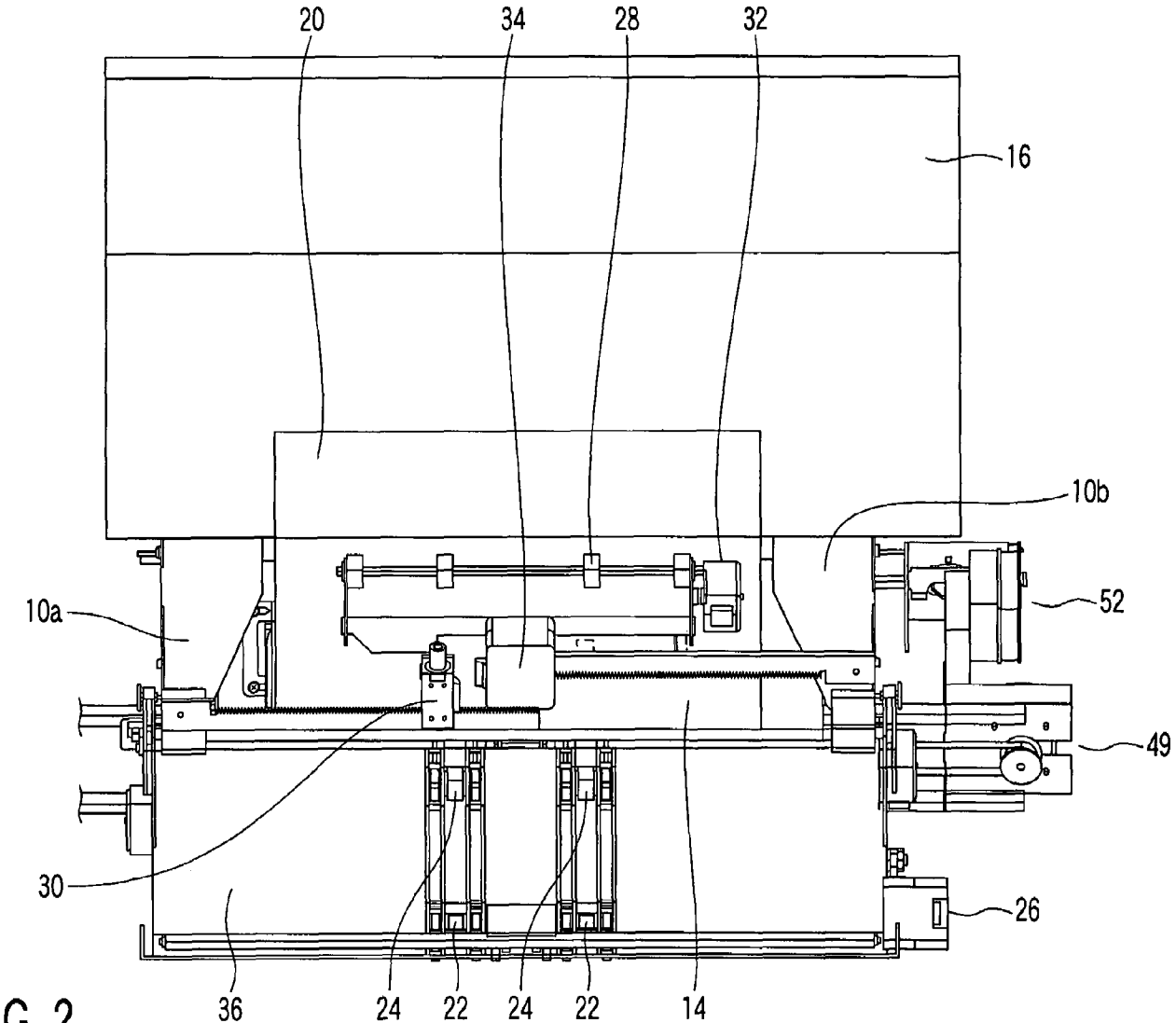
FIG. 2 is a top view of the post-process apparatus showing one embodiment of the invention.
Figure 3:
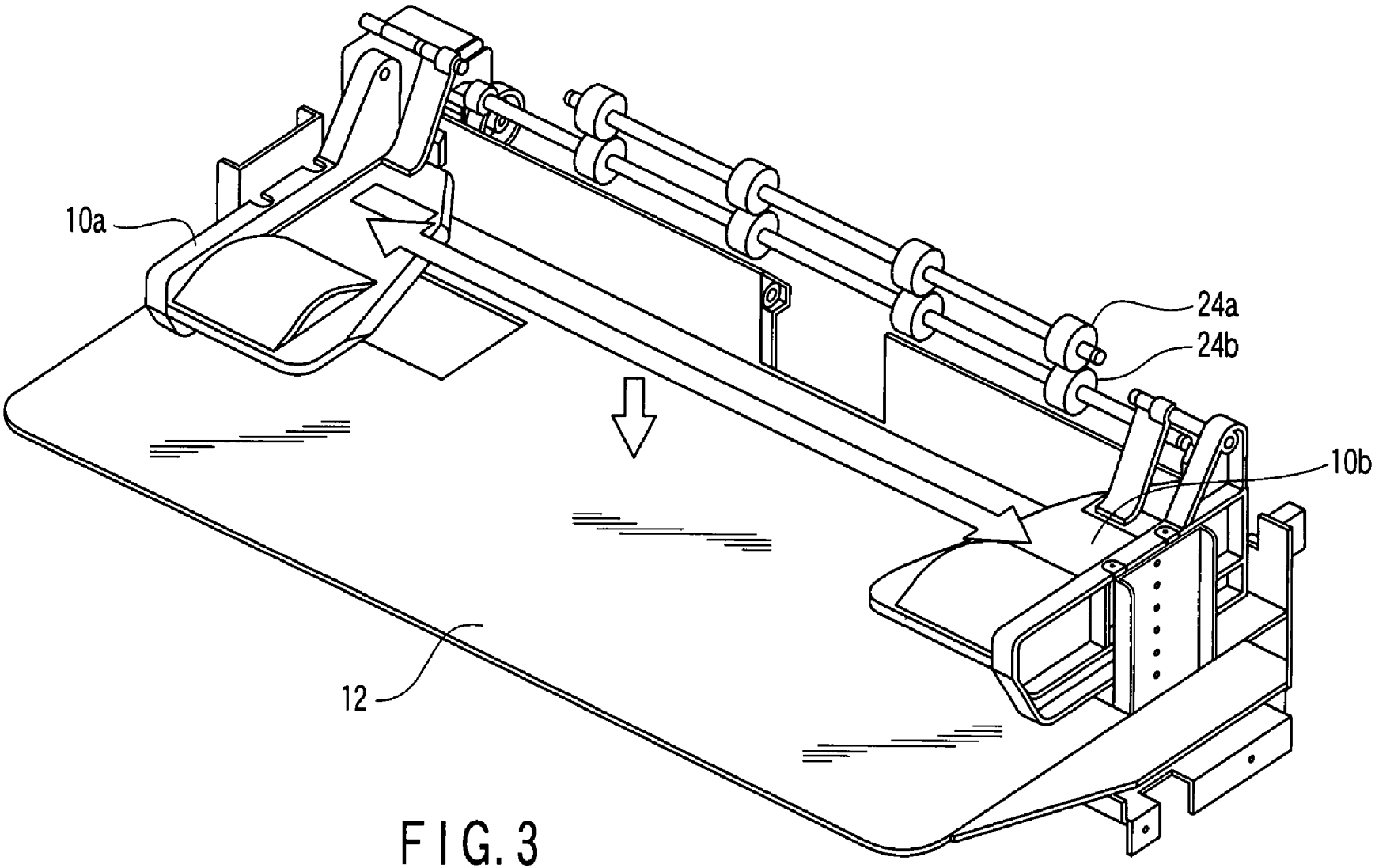
FIG. 3 is a view illustrating an operation of a waiting tray showing one embodiment of the invention.

The waiting tray will be described with reference to FIGS. 1, 2 and 3. As has been already described, when a preceding sheet is processed on the processing tray, a next sheet cannot be transported on the processing tray. The waiting tray is intended for make the next sheet standby in this state. The inlet roller 22 includes an upper inlet roller 22*a* and a lower inlet roller 22*b*. These rollers are driven by an inlet roller motor 26. A paper feed roller 24 includes an upper paper feed roller 24*a* and a lower paper feed roller 24*b*. These rollers are driven by a paper feed roller motor. A waiting tray roller 28 can be operated to be vertically elevated. This operation is controlled by a waiting tray roller drive source 30. The waiting tray roller 28 enables normal and invert rotation. This normal and invert rotation is carried out by a waiting tray roller motor 32.

On the waiting tray 10, left and right lower face support members 10*a* and 10*b* for supporting both sides of the lower face of a sheet carried into the waiting tray are provided in the left and right widthwise direction. A space between the left and right lower face support members is open. Therefore, a center portion of the sheet lower face is not supported. The upper faces of these left and right lower face support members 10*a* and 10*b* each are formed in a flat shape, and a curved face which is upwardly curved is formed at its top end side. Instead of this curved face or together with the curved face, a roller which is rotatable in an arbitrary direction may be engaged. The left and right lower face support members 10*a* and 10*b* are formed in the same width from the proximal end side to the distal end side. The width used here denotes a transverse direction in the case where the sheet transport direction is defined as a longitudinal direction. The left and right lower face support members 10*a* and 10*b* are set in location in which a sheet side face can be supported fully on the left and right lower face support members at a first position. At a second position, these support members are set in location in which the support of the sheet is released. The left and right lower face support members 10*a* and 10*b* are driven by a waiting tray motor 34. By means of this waiting tray motor 34, the left and right lower face support members 10*a* and 10*b* are moved to either of the first and second positions.

The waiting tray roller 28 returns the sheet transported to the waiting tray to the distal end side, and aligns the sheet distal end by abutting the sheet distal end against a distal end 60 of the waiting tray. In this case, although the sheets are located upwardly when they are transported to the waiting tray, the roller is lowered in the case where the sheet distal end is aligned. Then, the sheets are rotated while the sheets are compressed, and the sheets are pushed back. In addition, in the case where the sheets are transported from the waiting tray directly to the storage tray, the waiting roller is lowered and is rotated while the sheets are compressed, and the sheets are ejected. In this case, the rotation direction of the waiting tray roller 28 becomes inverted from that in the case where the sheets are abutted against the distal end side.

On the waiting tray, there is provided the sheet sensor 70 (refer to FIG. 18 or the like) for sensing a sheet to be proximal to the paper feed roller 24, i.e., at a side (upstream side) at which a sheet is carried in the waiting tray. This sheet sensor 70 senses the start of transport (sheet proximal end) by the paper feed roller 24 and the end of transport (sheet distal end) by the sheer feed roller 24. This sense signal is fed to control means of the post-process apparatus.

Figure 19:
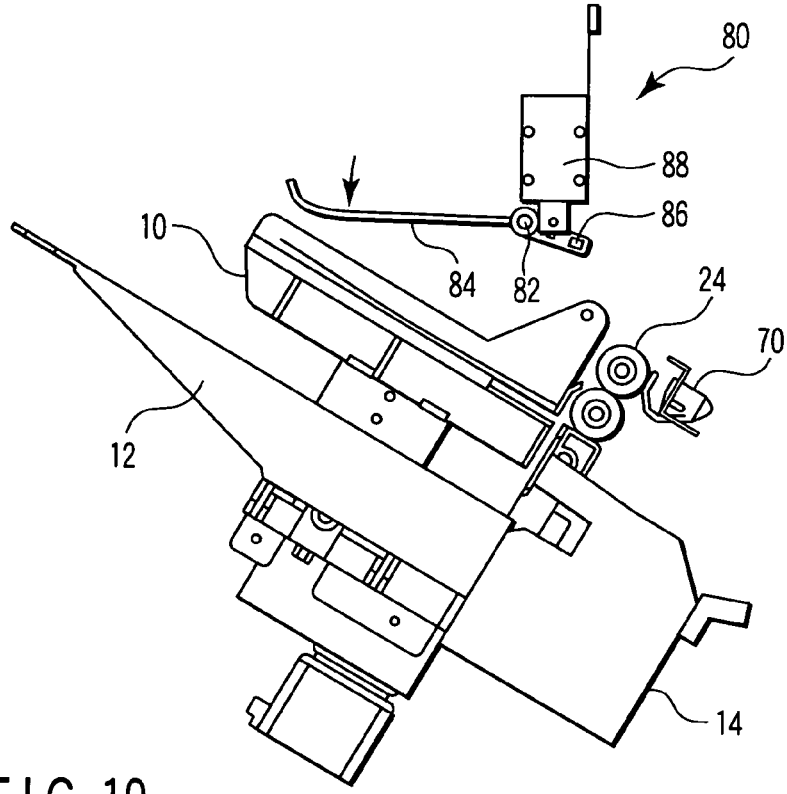
FIG. 19 is a side view of an upper face slash member of the waiting tray showing one embodiment of the invention.
Figure 20:
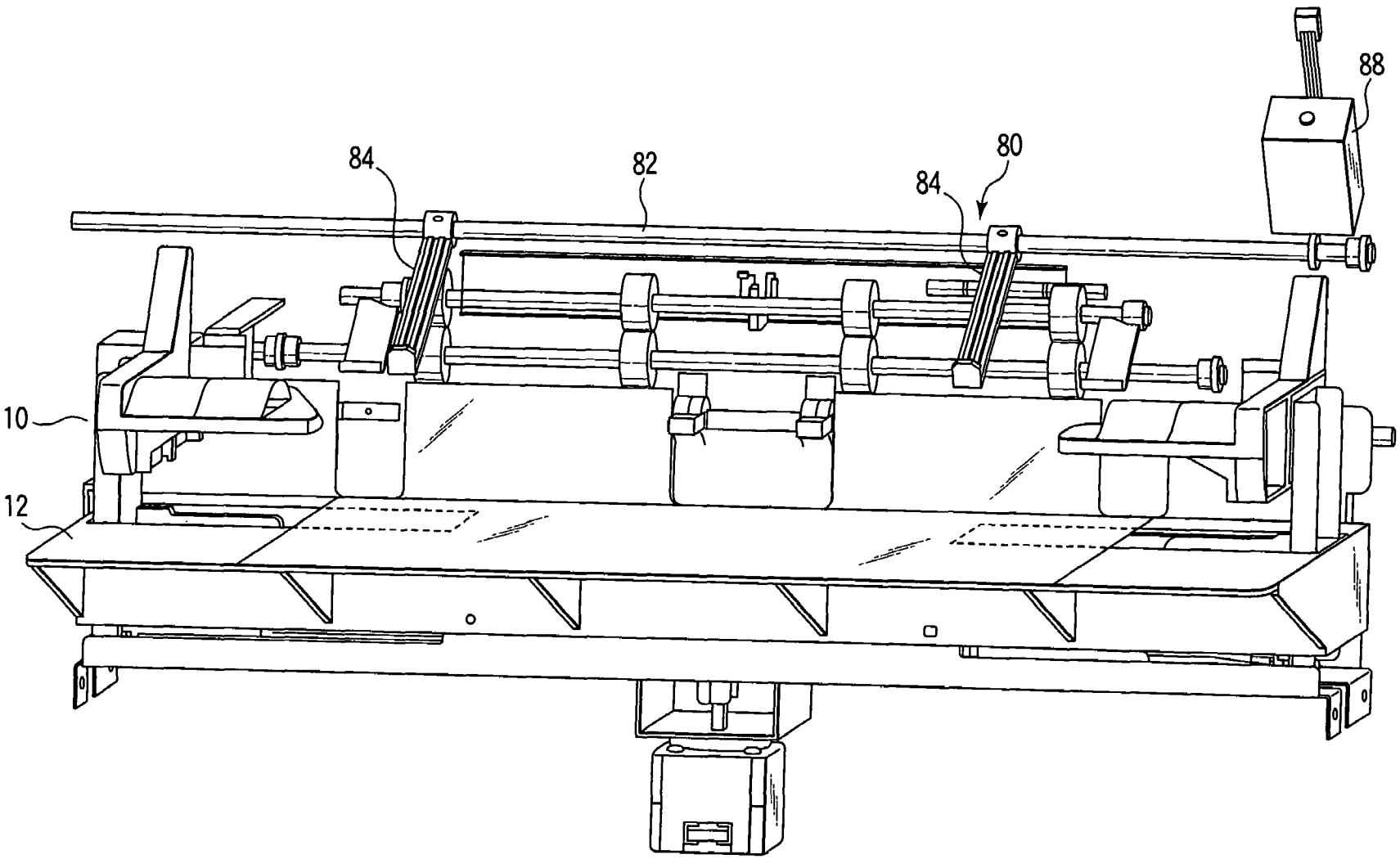
FIG. 20 is a view when the upper face slash member is seen from the proximal end side (downstream side) of the sheet.

Upward of the waiting tray 10, as shown in FIGS. 19 and 20, an upper face slash member 80 is provided in association with the sheet proximal end side in the waiting tray. This upward face slash member slashes an upper face of the sheet transported to the waiting tray and drops the sheet onto the processing tray 12. This upper face slash member 80 has: a shaft 82 allocated in the widthwise direction of the sheet upwardly of the sheet transported to the waiting tray; a spatula shaped body 84 extended to the proximal end side (downward side) in the transport direction of the sheer from this shaft, the spatula shaped body 84 being made of an elastic member such as flexible rubber; and a proximal section 86 projected at the opposite side of this piece shaped body with respect to the shaft. Further, a solenoid mechanism 88 for pulling up or pushing down this proximal section is provided. The proximal section 86 is pulled up by the solenoid mechanism 88, whereby the spatula shaped body 84 is swung in the downward direction indicated by the arrow so as to slash and drop the sheet held on the waiting tray onto the processing tray 12. In addition, after the sheet has been slashed and dropped, the proximal section 86 is pushed down by the solenoid mechanism 88, and the spatula shaped body 84 is risen in a direction opposite to that indicated by the arrow so that a next sheet can be transported to the waiting tray.

Figure 21:
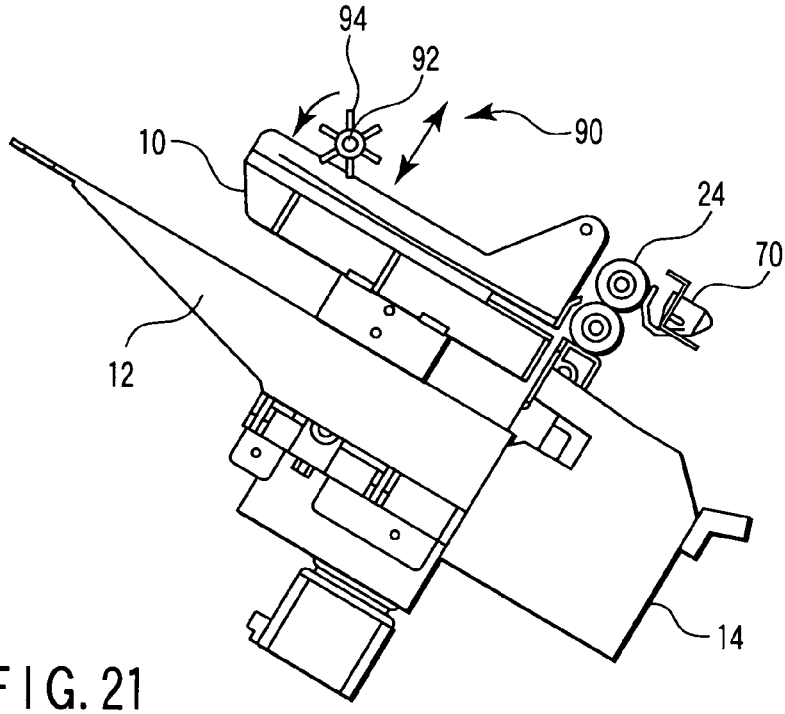
FIG. 21 is a view illustrating an upper face slash member of a waiting tray showing another embodiment of the present invention.

FIG. 21 shows another upper face slash member 90. This upper face slash member comprises a rotary shaft 92 and piece shaped bodies 94 projected at a plurality of portions with intervals on a peripheral face of the rotary shaft. During sheet transportation and during retention of the sheet in a waiting mode, this slash member is located above the waiting tray 10. During release of the retention, the upper face slash member 90 is lowered in a sheet direction up to a location in which the rotary shaft comes into contact with the sheet. Then, the rotary shaft 92 rotates, whereby the upper face slash piece 94 slashes the upper face of the sheet, and the sheet is dropped onto the processing tray 12.

Control means of the post-process apparatus having received information from the control means of the image processing apparatus (for example, the presence or absence of staple processing, how to carry out staple processing, the number of copies, and signal of size or the like of sheet to be copied) senses whether the sheet to be transported to the waiting tray is provided as a sheet which should be retained on the waiting tray in a waiting mode or is provided as a sheet which is not required to be retained in a waiting mode. For example, the control means senses that the first and second sheets are provided as sheets to be retained on the waiting tray in a waiting mode and the third or subsequent sheets are provided as sheets which are not required to be retained in a waiting mode, based on information indicating how to carry out staple processing. Alternatively, the control means senses that retention in a waiting mode on the waiting tray is not required from the information indicating that no staple processing is carried out. In addition, the control means having received a signal from the sheet sensor 70 senses a state in which the sheet is carried into the waiting tray 10. Then, the control means of the post-process apparatus instructs the drive motor of the lower face support members 10*a* and 10*b* to output a control signal of a release timing or a release quantity (release width) of the left and right lower face support members 10*a* and 10*b*. Then, a sheet is properly dropped onto the processing tray 12 with a proper timing.

<Processing Tray>

A processing tray carries out longitudinal or transverse alignment with respect to bundles of sheets dropped from a waiting tray, and carries out predetermined processing (for example, staple processing). This processing tray is allocated in a inclined shape which is high at the proximal end side and which is low at the distal end side.

Figure 4:
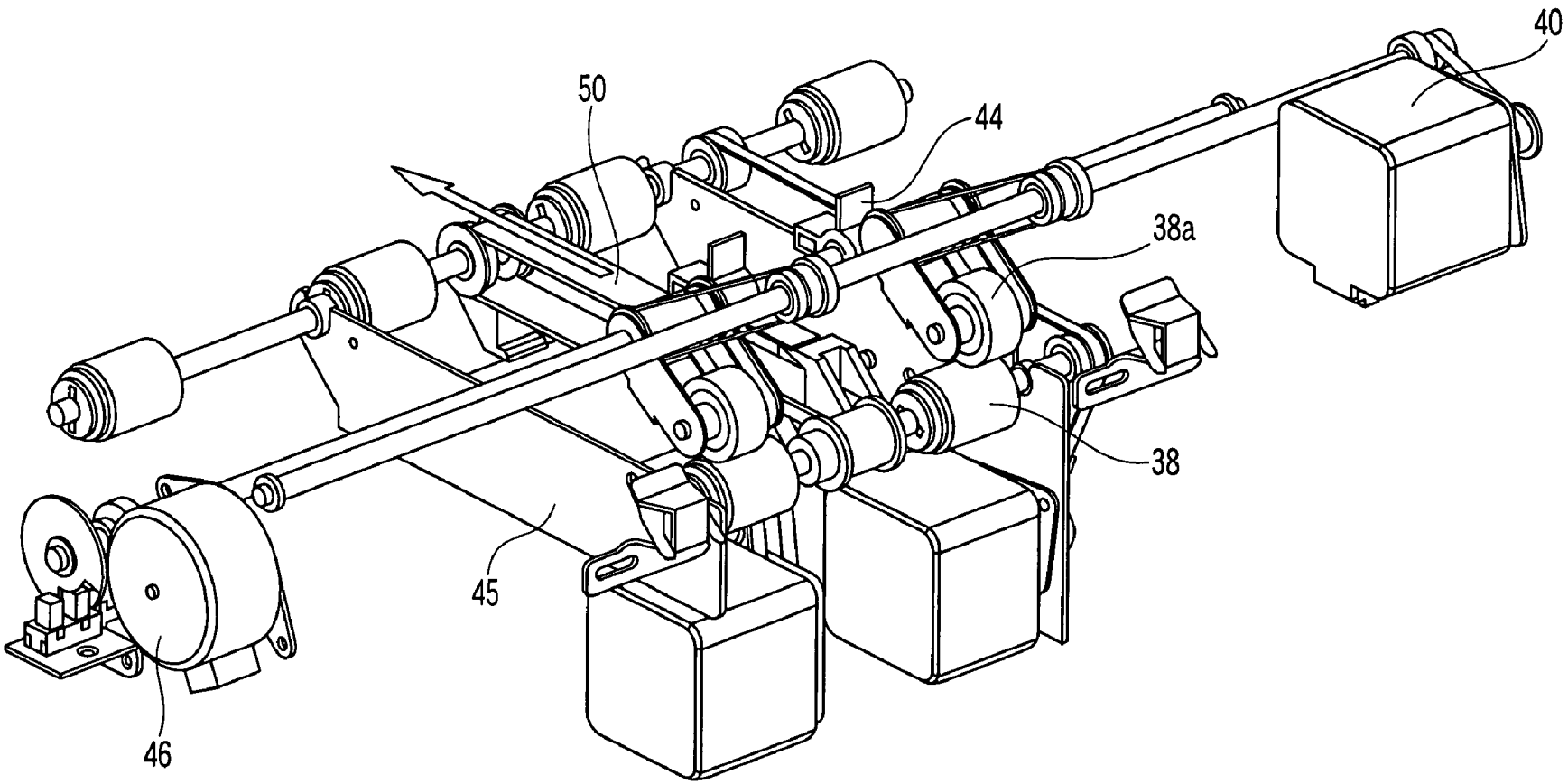
FIG. 4 is a view illustrating a longitudinal alignment and a sheet bundle transport mechanism of the post-process apparatus showing one embodiment of the invention.

As shown in FIG. 4, longitudinal alignment is carried out by a longitudinal alignment roller 38.

A longitudinal alignment upper roller 38*a* is driven by a longitudinal alignment upper roller motor 40.

A longitudinal alignment lower roller 38*b* is driven by a longitudinal alignment lower roller motor 42.

Sheets are aligned while a stopper 45 is defined as a reference. In addition, in order to assist this alignment, a paddle 44 is provided. This paddle 44 is driven by a paddle motor 46.

Figure 5:
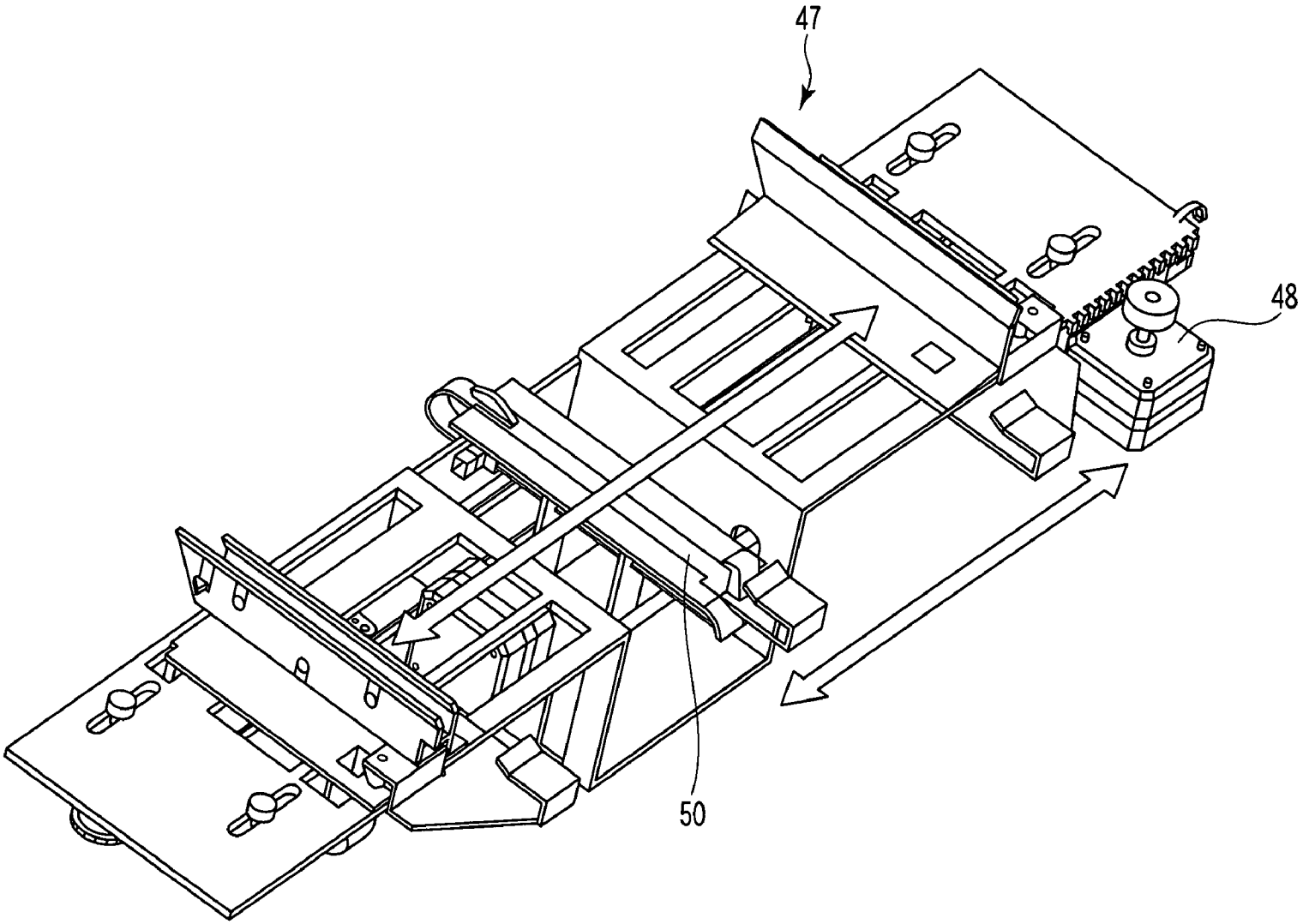
FIG. 5 is a view illustrating a transverse alignment mechanism of the post-process apparatus showing one embodiment of the invention.

As shown in FIG. 5, transverse alignment is executed by a transverse alignment mechanism 47 and a transverse alignment motor 48.

When a predetermined number of sheets are aligned and held on the processing tray 12, staple processing is carried out by the stapler 14.

Figure 6:
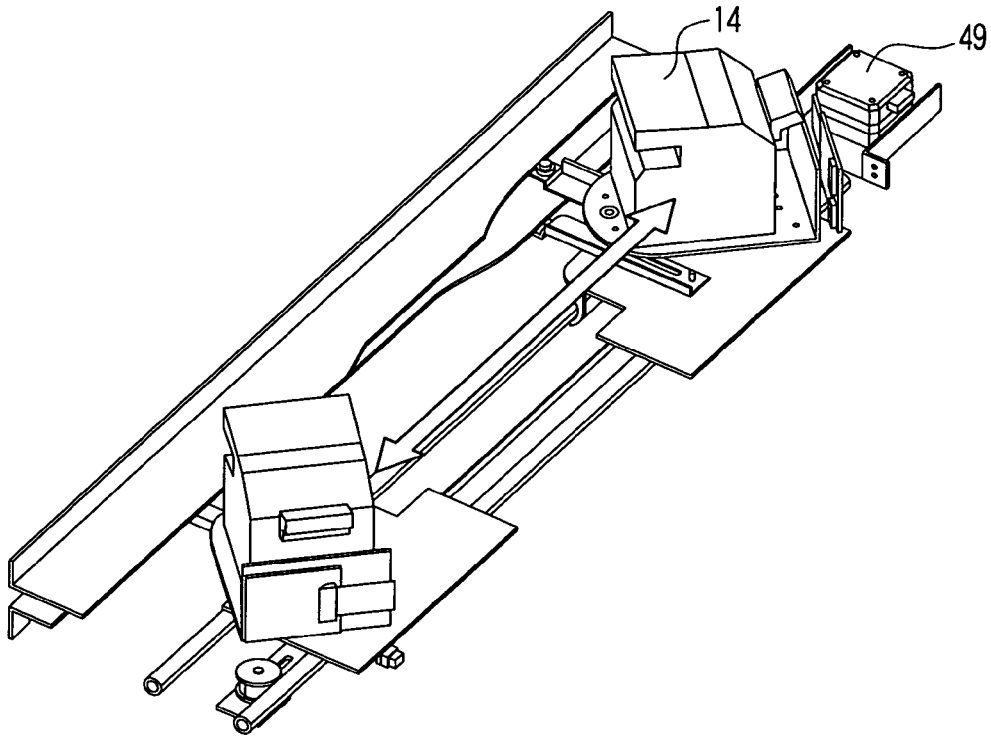
FIG. 6 is a view illustrating an operation of a stapler of the post-process apparatus showing one embodiment of the invention.
Figure 7:
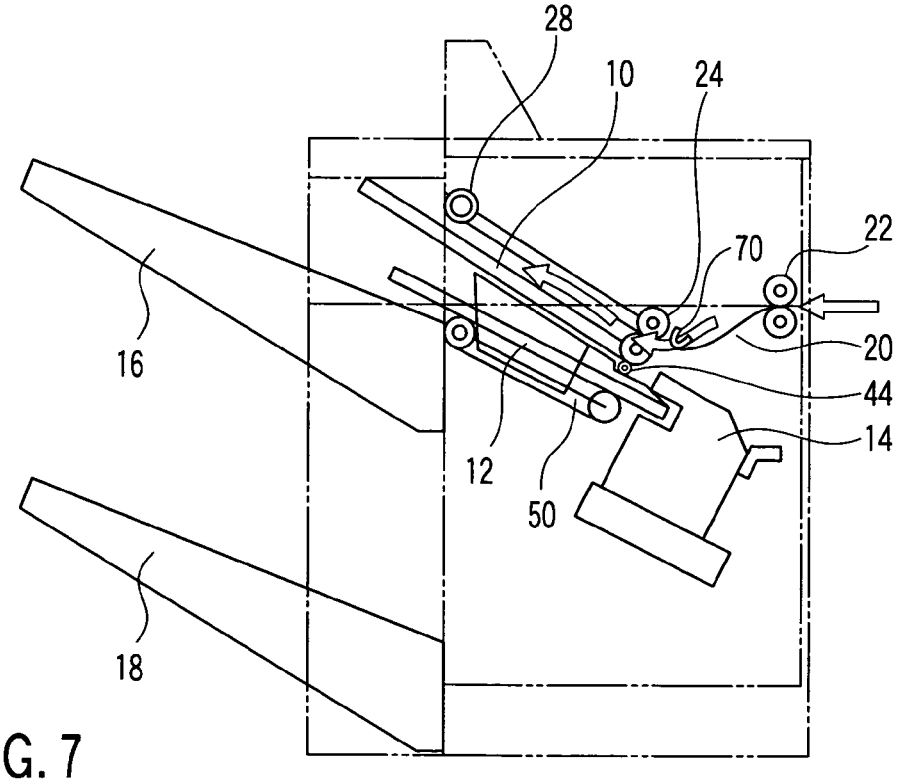
FIG. 7 is a view illustrating a flow of a first sheet of sheet between an inlet roller and a paper feed roller in the post-process apparatus showing one embodiment of the invention.
Figure 8:
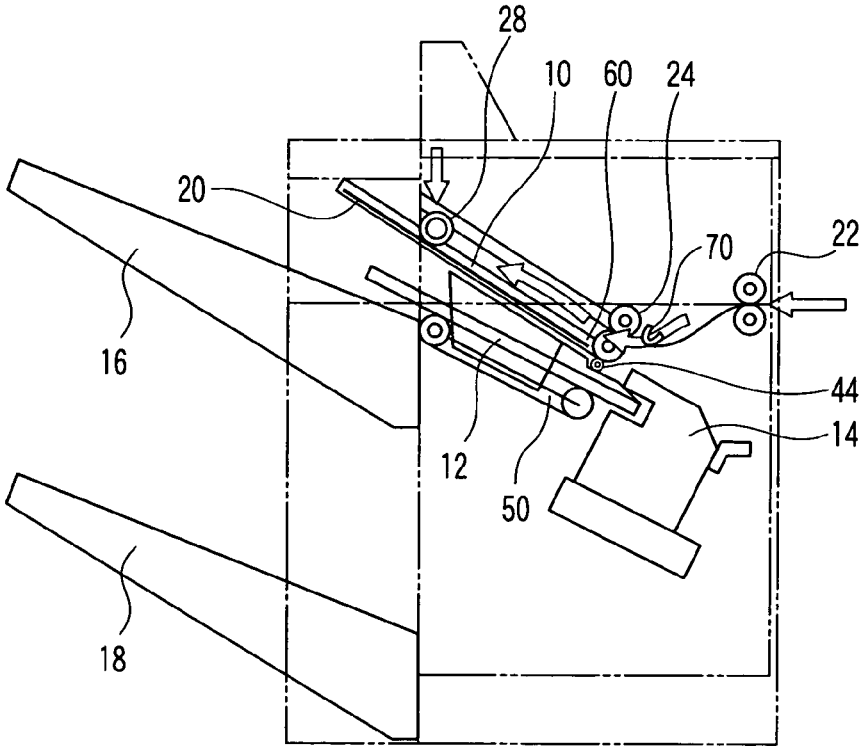
FIG. 8 is a view illustrating a flow of a first sheet of sheets between the paper feed roller and a standby roller in the post-process apparatus showing one embodiment of the invention.
Figure 9:
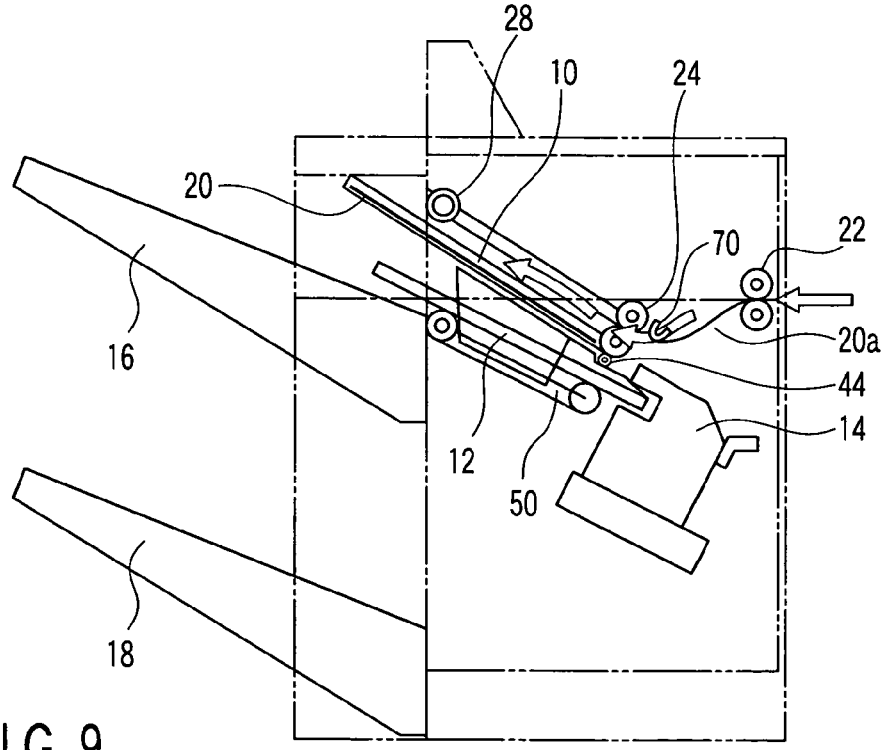
FIG. 9 is a view illustrating a flow of a second sheet of sheets between the paper feed roller and the standby roller in the post-process apparatus showing one embodiment of the invention.
Figure 10:
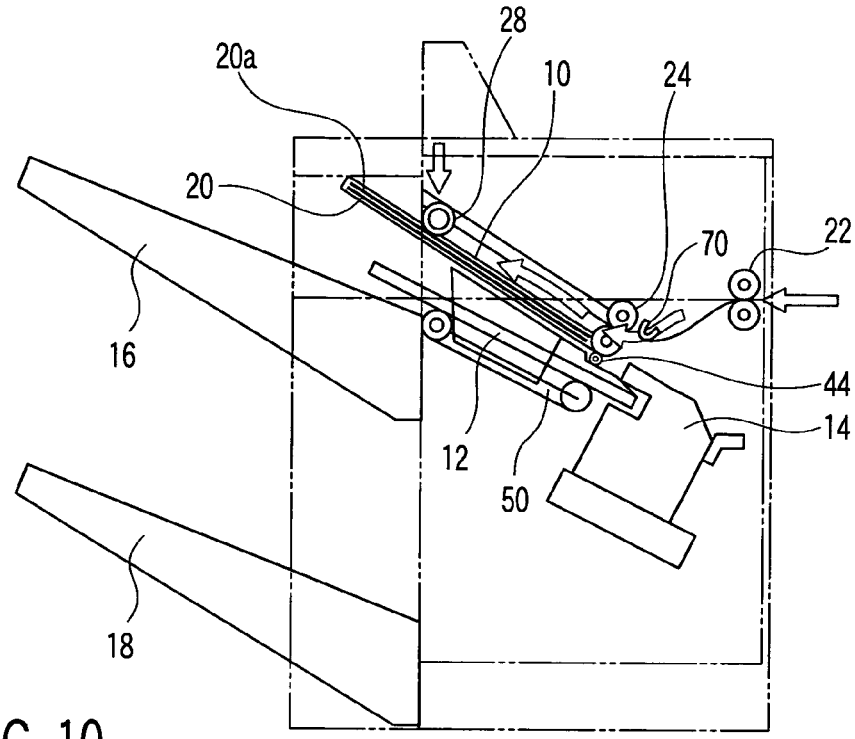
FIG. 10 is a view illustrating an operation of a waiting tray roller in the post-process apparatus showing one embodiment of the invention.

As shown in FIG. 6, the stapler 14 is positioned by a staple drive unit 49, and staple processing is controlled.

<Storage Tray>

As shown in FIG. 4, the staple processed bundles of sheets are sent to the storage tray 16 by the transport mechanism 50. Selection of the storage tray 16 or 18 is made by vertically moving the storage tray 16 or 18 by means of then storage tray drive unit 52.

In the case where sheets are directly ejected from the waiting tray 10, the storage tray is risen up to a location which corresponds to a sheet outlet of the waiting tray.

(Description of Operation)

Now, an operation of the post-process apparatus according to the present invention will be described with reference to FIGS. 7 to 18.

<Operation in Case where Staple Processing is Carried Out>

As has been already described, staple processing on a processing tray is slow as compared with that on the image processing apparatus. Thus, when a sheet transported from the image processing apparatus is processed on the processing tray, a buffer unit is provided at the front stage thereof. Then, it is necessary to make a next sheet standby not so as to be transported to the processing tray until the staple processing on the processing tray has completed. In this example, a description will be given with respect to a case in which two sheets (first and second sheets) are made standby on the waiting tray, and the third and subsequent sheets are not required to be made standby.

A sheet from the image processing apparatus is transported to the waiting tray 10 via the inlet roller 22 and the paper feed roller 24. The sheet is retained by the left and right lower face support members 10*a* and 10*b* and the distal end support member which are set at a first position, the waiting tray roller 28 is lowered, and the sheet distal end is aligned (this alignment is made with the distal end 60 of the waiting tray 10 (upstream side)).

Figure 11:
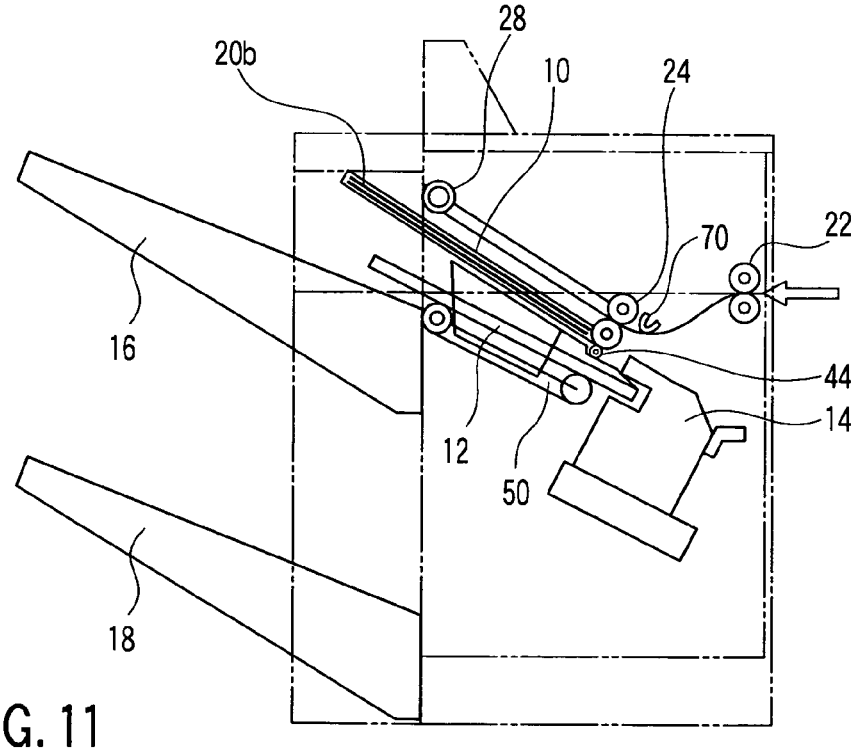
FIG. 11 is a view illustrating an operation of the waiting tray roller in the post-process apparatus showing one embodiment of the invention.
Figure 12:
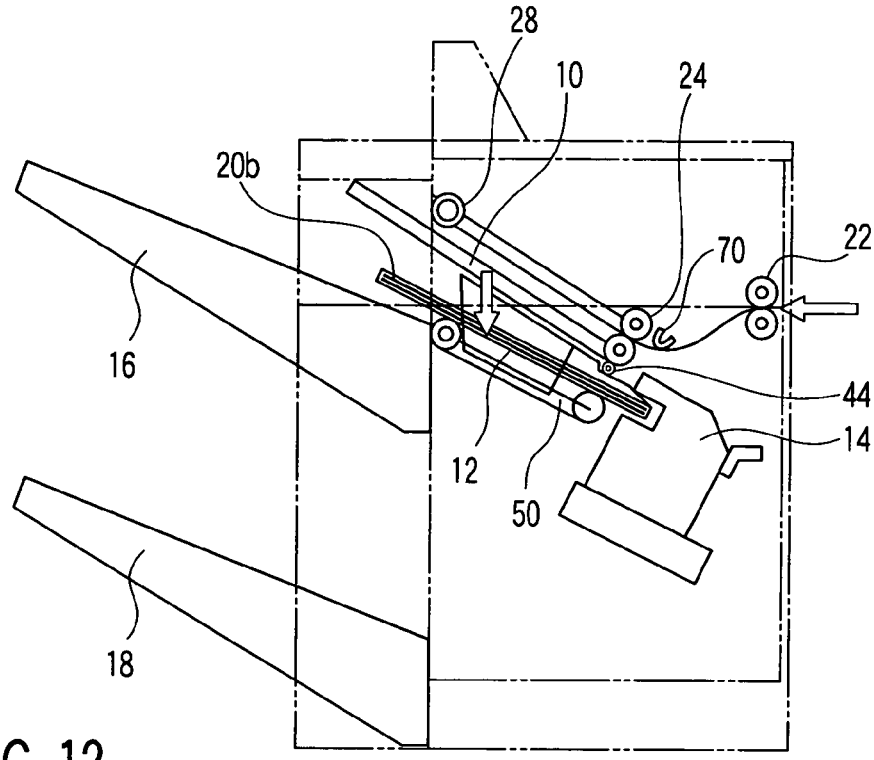
FIG. 12 is a view illustrating an operation of an active drop in the post-process apparatus showing one embodiment of the invention.

Next, the waiting tray roller 28 is risen, and is ready for accepting a second sheet 20*a*. When the second sheet 20*a* is sent to the waiting tray 10, the waiting tray roller 28 is lowered to align a location of the sheet with the distal end 60 of the waiting tray 10. Then, the waiting tray roller 28 is risen (FIG. 11). When the second sheet is transported to the waiting tray, the distal end portion of the sheet is sensed by the sheet sensor 70. Based on this sense signal, the first and second sheets are dropped onto the processing tray 12 altogether. That is, the left and right lower face support members 10*a* and 10*b* are released to be located at a second position so as to release support of both sides of the sheet. At this time, the upper face slash member 80 or 90 slashes an upper face of the sheet, and forcibly drops the sheet onto the processing tray 12. By doing this, the sheet is reliably dropped onto the processing tray and the processing speed can be increased.

Then, with respect to the third and subsequent sheets, the waiting tray is kept in a state in which the support of the sheet is released, and the sheet is transported from the paper feed roller 24 directly to the waiting tray.

Figure 13:
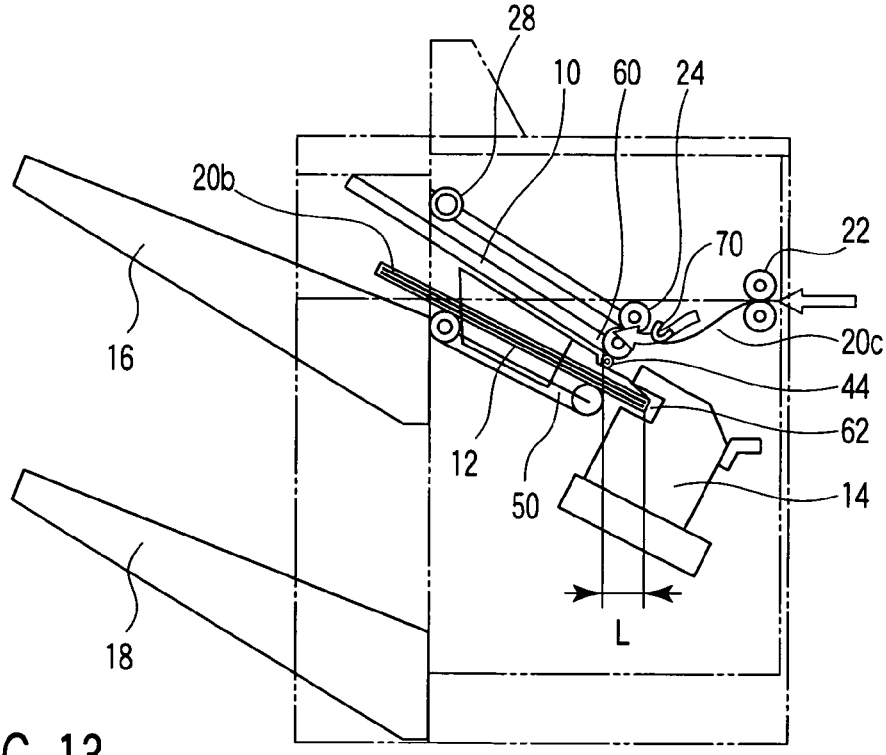
FIG. 13 is a view illustrating a flow of a third sheet of sheets in the post-process apparatus showing one embodiment of the invention.

A state in which the second sheet is held on the processing tray 12 will be first described. In the processing tray 12, a predetermined number of bundles of sheets 21 are formed to be held on two bundles of sheets 20*b*. At this time, the longitudinal and transverse alignment mechanisms 38 and 47 function, and longitudinal and transverse sheet alignments are executed. At this time, as shown in FIG. 13, a distal end 60 of the waiting tray 10 and a distal end (upstream side) 62 of the processing tray 12 are spaced in a transverse direction with a distance L so that the distal end 60 of the waiting tray 10 exists on the downstream side more than the distal end (upstream side) 62 of the processing tray 12. With such a construction, the bundle of sheets 20*b* can be easily dropped from the waiting tray 10 to the processing tray 12, and an aligning operation using the longitudinal and transverse alignment mechanisms 38 and 47 can be easily made. As a result, an occurrence of jamming can be prevented.

The processing tray 12 is allocated to be obliquely inclined together with the waiting tray 10. Thus, the distal ends 60 and 62 of the respective trays are located at the lowest position, and the sheet 20 and the bundle of sheets 21 can be aligned with the distal ends 60 and 62 by a self load of the sheet 20 and the bundle of sheets 21.

Figure 14:
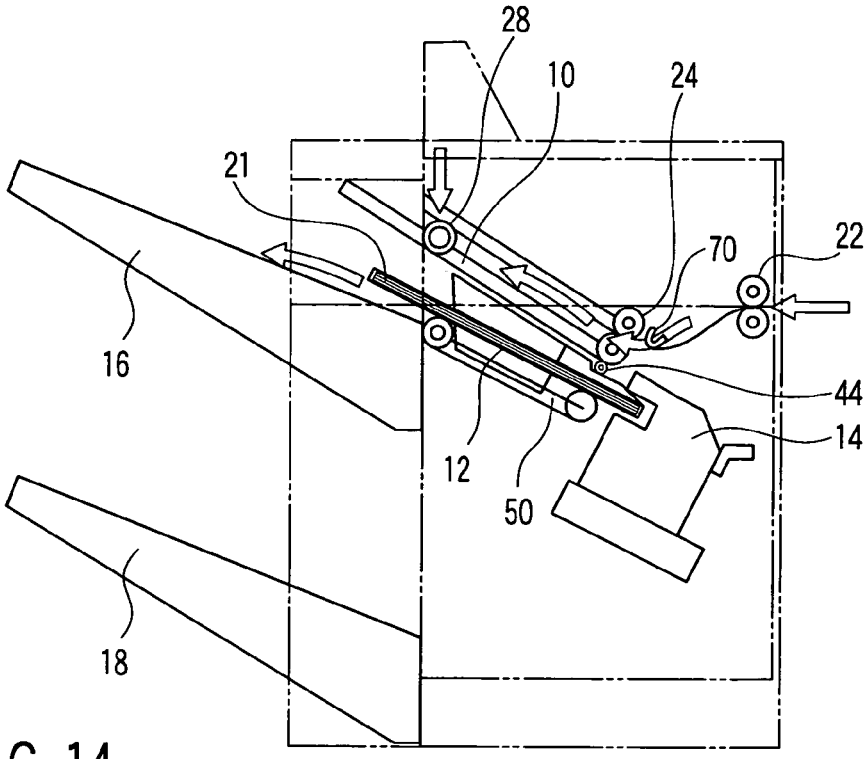
FIG. 14 is a view illustrating an operation of a stapler in the post-process apparatus showing one embodiment of the invention.
Figure 15:
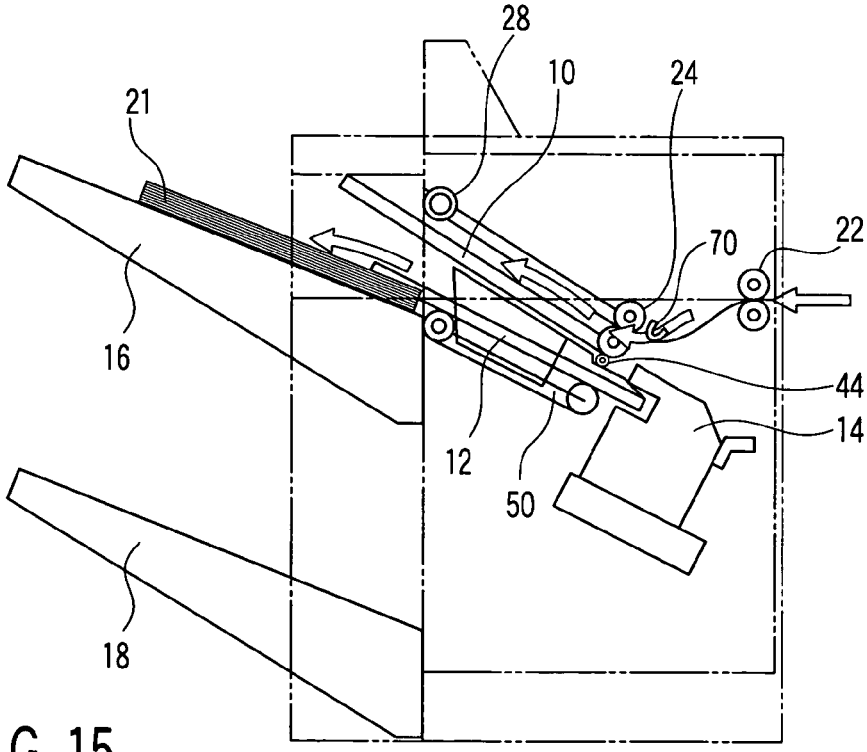
FIG. 15 is a view illustrating a flow of a bundle of sheets between a processing tray and a storage tray in the post-process apparatus showing one embodiment of the invention.

Next, as shown in FIG. 14, the bundle of sheets 21 is staple processed by the stapler 14. Then, as shown in FIG. 15, the bundle of sheets 20 is fed to the storage tray 16 by the transport mechanism 50, and post-process terminates.

<Processing in the Case where No Post-Process is Carried Out>

Figure 16:
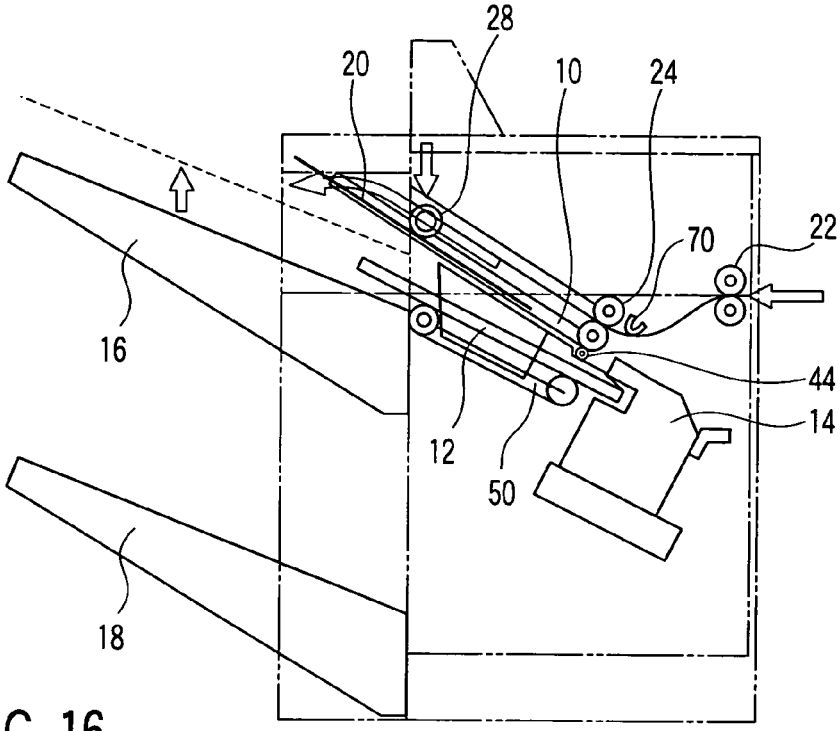
FIG. 16 is a view illustrating a flow of direct sheet ejection of a sheet from the waiting tray to the storage tray in the post-process apparatus showing one embodiment of the invention.
Figure 17:
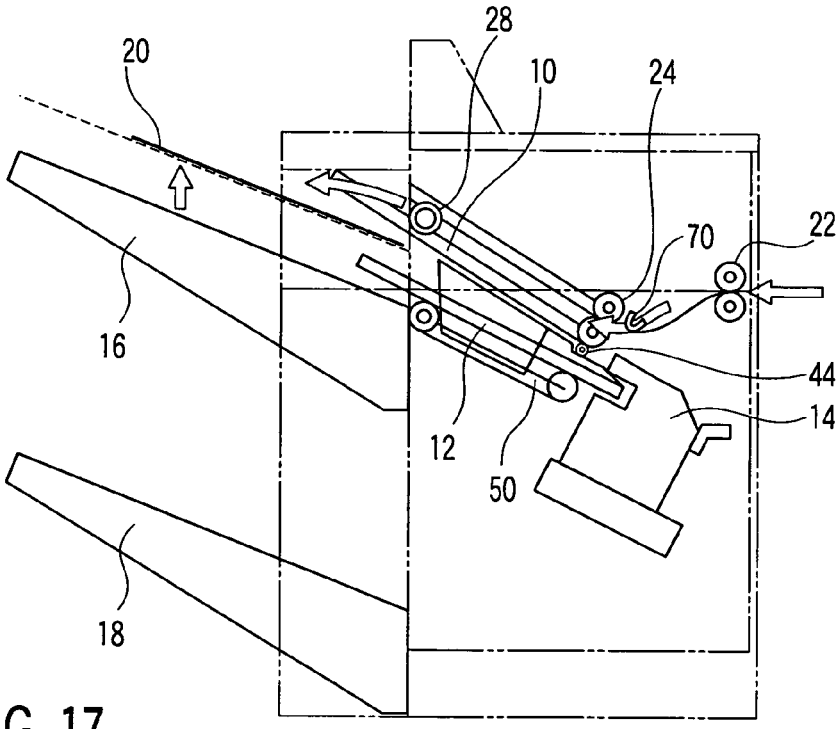
FIG. 17 is a view illustrating an operation of a position change of the storage tray in the post-process apparatus showing one embodiment of the invention.

In the case where no post-process is carried out (such as a case in which no staple processing is carried out or a case in which jamming occurs), as shown in FIGS. 16 and 17, a sheet is ejected from the waiting tray 10 directly to the storage tray 16 without intervening the processing tray 12. As shown in FIG. 16, the sheet fed from the image processing apparatus is fed to the storage tray 16 via the inlet roller 22, the sheet feed roller 24, and the waiting tray 10. The storage tray 16, as shown in FIG. 17, is slightly risen by the storage tray drive unit 52 to receive the sheet fed from the waiting tray 10.

Although the embodiments of the present invention have been described above, the present invention is not limited to the embodiments. Constituent elements shown in the embodiments can be changed to other constituent elements as long as they have same functions.

What is claimed is:

1. A sheet post-process apparatus, the apparatus comprising:

a waiting tray which temporarily retains a transported sheet in a waiting mode, and releases the retention to drop the sheet;

a processing tray which bundles sheets dropped from the waiting tray to carry out predetermined processing, and ejects the sheets; and a storage tray which holds the bundle of sheets processed and ejected by the processing tray, wherein the waiting tray comprises:

left and right lower face support members which support left and right lower faces in a sheet transport direction during retention in the waiting mode and release the support of the left and right lower faces during release of the retention; and an upper face slash member allocated upwardly of the left and right lower face support members, the slash member slashing an upper face of the sheet transported to the waiting tray and pushing the upper face of the sheet in a direction of the processing tray to drop the sheet onto the processing tray.

2. A sheet post-process apparatus according to claim 1, wherein the upper face slash member comprises a spatula shaped body whose proximal end side is lowered in a sheet direction while a proximal shaft side is defined as a turning center.

3. A sheet post-process apparatus according to claim 1, wherein the upper face slash member projects one or a plurality of piece shaped bodies for slashing an upper face of sheet with intervals in a peripheral direction of a rotary shaft.

4. A sheet post-process apparatus according to claim 1, wherein the upper face slash member is allocated so as to slash a center portion at a proximal end in a sheet transport direction.

5. A sheet post-process apparatus according to claim 1, wherein the waiting tray is allocated to be proximal to an upper stage of the processing tray, the processing tray and the waiting tray are allocated in an inclined shape which is high at a proximal end side of a sheet to be transported and which is low at a distal end side, the processing tray and the waiting tray are shorter in length of a sheet transport direction thereof than a length of a standard sheet to be held, and a part of the proximal end side in the transport direction of the sheet to be held on the processing tray is held on the storage tray.

6. A sheet post-process apparatus according to claim 1, further comprising rollers provided at a distal end and at a proximal end of the waiting tray.

7. A sheet post-process apparatus according to claim 1, further comprising a transport mechanism provided on the processing tray to transport the bundle of sheets to the storage tray.

8. A sheet post-process apparatus according to claim 1, wherein the waiting tray expands to accommodate different size sheets.

9. A sheet post-process apparatus according to claim 1, further comprising an alignment mechanism provided on the processing tray.

10. A sheet post-process apparatus according to claim 1, wherein the storage tray moves in a vertical direction.

11. A sheet post-process apparatus, the apparatus comprising:

waiting means for temporarily retaining a transported sheet in a waiting mode and releasing the retention to drop the sheet;

processing means for bundling sheets dropped from the waiting means to carry out predetermined processing and ejecting the sheets; and storage means for holding the bundle of sheets processed and ejected by the processing means, wherein the waiting means comprises:

left and right lower face support means for supporting left and right lower faces in a sheet transport direction during retention in the waiting mode and releasing the support of the left and right lower faces during release of the retention; and upper face slash means allocated upwardly of the left and right lower face support means, for slashing an upper face of the sheet transported to the waiting means and pushing the upper face of the sheet in a direction of the processing means to drop the sheet onto the processing means.

12. A sheet post-process apparatus according to claim 11, wherein the upper face slash means comprises a spatula shaped body whose proximal end side is lowered in a sheet direction while a proximal shaft side is defined as a turning center.

13. A sheet post-process apparatus according to claim 11, wherein the upper face slash means projects one or a plurality of piece shaped bodies for slashing an upper face of the sheet with intervals in a peripheral direction of a rotary shaft.

14. A sheet post-process apparatus according to claim 11, wherein the upper face slash means is allocated so as to slash a center portion at a proximal end in a sheet transport direction.

15. A sheet post-process apparatus according to claim 11, wherein the waiting means is allocated to be proximal to an upper stage of the processing means, the processing means and the waiting means are allocated in an inclined shape which is high at a proximal end side of a sheet to be transported and which is low at a distal end side, the processing means and the waiting means are shorter in length of a sheet transport direction thereof than a length of a standard sheet to be held, and a part of the proximal end side in the transport direction of the sheet to be held on the processing means is held on the storage means.

16. A sheet post-process apparatus according to claim 11, further comprising rollers provided at a distal end and at a proximal end of the waiting means.

17. A sheet post-process apparatus according to claim 11, further comprising a transport means provided on the processing means to transport the bundle of sheets to the storage means.

18. A sheet post-process apparatus according to claim 11, wherein the waiting means expands to accommodate different size sheets.

19. A sheet post-process apparatus according to claim 11, further comprising an alignment means provided on the processing means.

20. A sheet post-process apparatus according to claim 11, wherein the storage means moves in a vertical direction.

* * * * *